US011668531B2

(12) United States Patent
Retersdorf et al.

(10) Patent No.: US 11,668,531 B2
(45) Date of Patent: Jun. 6, 2023

(54) SUBFREEZING HEAT EXCHANGER WITH SEPARATE MELT FLUID

(71) Applicant: Hamilton Sundstrand Corporation, Charlotte, NC (US)

(72) Inventors: Alan Retersdorf, Avon, CT (US); Michael Doe, Southwick, MA (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 0 days.

(21) Appl. No.: 17/112,087

(22) Filed: Dec. 4, 2020

(65) Prior Publication Data

US 2022/0178621 A1 Jun. 9, 2022

(51) Int. Cl.

| | |
|---|---|
| ***F28D 9/00*** | (2006.01) |
| ***F28F 3/02*** | (2006.01) |
| ***F28F 9/02*** | (2006.01) |
| *F28F 27/02* | (2006.01) |
| *F28D 1/053* | (2006.01) |
| *F28D 1/04* | (2006.01) |

(52) U.S. Cl.

CPC ..... *F28D 9/0093* (2013.01); *F28F 3/02* (2013.01); *F28F 9/0234* (2013.01); *F28D 1/0408* (2013.01); *F28D 1/05308* (2013.01); *F28D 1/05358* (2013.01); *F28F 9/0217* (2013.01); *F28F 9/0246* (2013.01); *F28F 27/02* (2013.01); *F28F 2009/0287* (2013.01)

(58) Field of Classification Search

CPC .. F28D 9/0093; F28D 9/0062; F28D 1/05358; F28D 1/05308; F28D 1/0408; F28F 27/02; F28F 3/02; F28F 9/0287; F28F 9/0234; F28F 9/0246; F28F 9/26; F28F 9/0217; F28F 2009/0287

USPC ..... 165/166, 140

See application file for complete search history.

(56) References Cited

U.S. PATENT DOCUMENTS 3,196,942 A * 7/1965 Prentiss ..... F28D 9/0068 165/166

3,601,185 A * 8/1971 Rothman ..... F28F 3/025 165/166

4,246,963 A 1/1981 Anderson (Continued)

FOREIGN PATENT DOCUMENTS

EP 0019492 B1 4/1986

OTHER PUBLICATIONS

Extended European Search Report for EP Application No. 21212244.4, dated May 11, 2022.

*Primary Examiner* — Joel M Attey

(74) *Attorney, Agent, or Firm* — Kinney & Lange, P.A.

(57) ABSTRACT

A heat exchanger includes a first side opposite a second side and a third side opposite a fourth side and a cold layer with an inlet at the first side of the heat exchanger, an outlet at the second side of the heat exchanger, and a cold passage extending from the inlet to the outlet. The heat exchanger also includes a hot layer with an inlet manifold at the third side of the heat exchanger extending between the first side and the second side, an outlet manifold at the fourth side of the heat exchanger opposite the inlet manifold and extending between the first side and the second side, a hot passage extending from the inlet manifold to the outlet manifold, and a tube on the first side of the heat exchanger extending from the third side to the fourth side.

13 Claims, 3 Drawing Sheets

(56) References Cited

U.S. PATENT DOCUMENTS

| | | | | | |
|---|---|---|---|---|---|
| 4,352,273 | A * | 10/1982 | Kinsell | B64D 13/06 | 62/87 |
| 4,862,952 | A * | 9/1989 | Tarasewich | F28F 19/006 | 165/54 |
| 4,923,001 | A * | 5/1990 | Marcolin | F28D 1/0443 | 165/173 |
| 6,460,353 | B2 * | 10/2002 | Udobot | F28F 19/006 | 62/86 |
| 8,276,651 | B2 * | 10/2012 | Min | F28F 9/0234 | 165/110 |
| 8,276,654 | B2 | 10/2012 | Zaffetti et al. | | |
| 2013/0061617 | A1 | 3/2013 | Borghese et al. | | |
| 2014/0290920 | A1 * | 10/2014 | Ouradnik | F28F 3/025 | 165/140 |
| 2019/0390915 | A1 * | 12/2019 | St. Rock | F28F 7/02 | |

* cited by examiner

SUBFREEZING HEAT EXCHANGER WITH SEPARATE MELT FLUID

BACKGROUND

The present disclosure relates to heat exchangers, and in particular to plate-fin crossflow heat exchangers.

Heat exchangers are often used to transfer heat between two fluids. For example, in aircraft environmental control systems, heat exchangers may be used to transfer heat between a relatively hot air source (e.g., bleed air from a gas turbine engine) and a relatively cool air source (e.g., ram air). Some heat exchangers, often referred to as plate-fin heat exchangers, include a plate-fin core having multiple heat transfer sheets arranged in layers to define air passages there between. Closure bars seal alternating inlets of hot air and cool air inlet sides of the core. Accordingly, hot air and cool air are directed through alternating passages to form alternating layers of hot and cool air within the core. Heat is transferred between the hot and cool air via the heat transfer sheets that separate the layers. In addition, to facilitate heat transfer between the layers, each of the passages can include heat transfer fins, often formed of a material with high thermal conductivity (e.g., aluminum), that are oriented in the direction of the flow within the passage. The heat transfer fins increase turbulence and a surface area that is exposed to the airflow, thereby enhancing heat transfer between the layers.

In some applications, heat exchangers can be exposed to extremely cold temperatures. When a heat exchanger is exposed to extremely cold temperatures ice accretion can occur. When there is ice accretion on a heat exchanger the ice accretion can result in restricting airflow into or out of the heat exchanger, thereby increasing the pressure loss across the heat exchanger and decreasing heat transfer performance.

SUMMARY

In one example, a heat exchanger includes a first side opposite a second side and a third side opposite a fourth side. The third side and the fourth side extend from the first side to the second side. The heat exchanger also includes a cold layer with an inlet at the first side of the heat exchanger and an outlet at the second side of the heat exchanger. The cold layer also includes a cold passage extending from the inlet to the outlet. The heat exchanger also includes a hot layer with an inlet manifold at the third side of the heat exchanger extending between the first side and the second side and an outlet manifold at the fourth side of the heat exchanger opposite the inlet manifold and extending between the first side and the second side. The hot layer also includes a hot passage extending from the inlet manifold to the outlet manifold and a tube on the first side of the heat exchanger extending from the third side to the fourth side.

In another example, a heat exchanger includes a first side opposite a second side and a third side opposite a fourth side, wherein the third side and the fourth side extend from the first side to the second side. The heat exchanger also includes a cold layer with a first closure bar on the third side extending from the first side to the second side, a second closure bar on the fourth side extending from the first side to the second side, and a cold passage between the first closure bar and the second closure bar, wherein the cold passage includes an inlet on the first side. The heat exchanger also includes a hot layer adjacent the cold layer. The hot layer includes a third closure bar on the second side extending from the third side to the fourth side, a closure tube on the first side extending from the third side to the fourth side. The closure tube includes a heating fluid passage extending from the third side to the fourth side. The hot layer also includes a hot passage between the third closure bar and the closure tube. The hot passage includes an inlet on the third side and an outlet on the fourth side.

In another example, a method of preventing ice accretion on a cold inlet of a cold layer of a heat exchanger includes directing a cold flow through the cold inlet of the cold layer at a first side of the heat exchanger and out a cold outlet of the cold layer at a second side of the heat exchanger. The method also includes directing a hot flow through a hot inlet header of a hot layer at a third side of the heat exchanger and out the hot outlet header of the hot layer at the fourth side of the heat exchanger. The method also includes directing a heating fluid through a tube located on the first side of the heat exchanger. The heating fluid heats the cold inlet of the cold layer of the heat exchanger.

DETAILED DESCRIPTION

The present disclosure relates to a heat exchanger. The heat exchanger includes a cold layer and a hot layer. The hot layer includes a closure tube with a heating fluid passage configured to prevent ice accretion on the inlet of the cold layer. The heat exchanger will be described below with reference to FIGS. 1-3.

Figure 1:
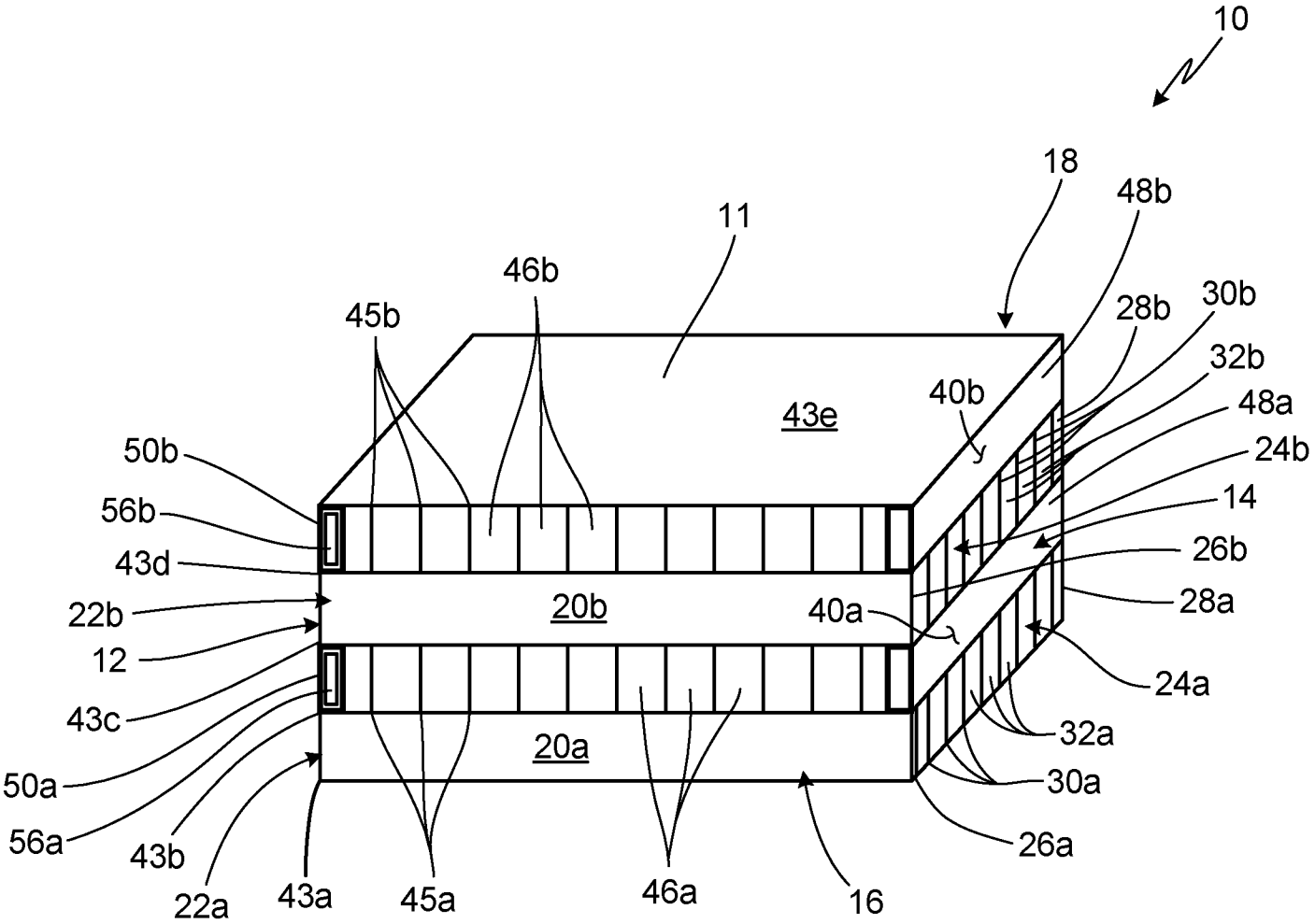
FIG. 1 is a perspective view of a core of a heat exchanger.

FIG. 1 is a perspective view of an example of a core of heat exchanger 10. Heat exchanger 10 includes core 11. Core 11 includes first side 12, second side 14, third side 16, fourth side 18, first cold layer 20*a*, second cold layer 20*b*, first hot layer 40*a*, second hot layer 40*b*, and parting sheets (43*a*, 43*b*, 43*c*, 43*d*, and 43*e*). First cold layer 20*a* includes first cold inlet 22*a*, first cold outlet 24*a*, first lower closure bar 26*a*, second lower closure bar 28*a*, a plurality of first cold fins 30*a*, and first cold passages 32*a*. First hot layer 40*a* includes a plurality of first hot fins 45*a*, first hot passages 46*a*, third lower closure bar 48*a*, first closure tube 50*a*. First closure tube 50*a* includes first heating fluid passage 56*a*. Second cold layer 20*b* includes second cold inlet 22*b*, second cold outlet 24*b*, first upper closure bar 26*b*, second upper closure bar 28*b*, a plurality of second cold fins 30*b*, and second cold passages 32*b*. Second hot layer 40*b* includes a plurality of second hot fins 45*b*, second hot passages 46*b*, third upper closure bar 48*b*, second closure tube 50*b*. Second closure tube 50*b* includes second heating fluid passage 56*b*.

First cold layer 20*a* is adjacent to first hot layer 40*a* and first cold layer 20*a* is separated from first hot layer 40*a* by parting sheet 43*b*. First hot layer 40*a* is also adjacent to second cold layer 20*b* and first hot layer 40*a* is separated from second cold layer 20*b* by parting sheet 43*c*. Second cold layer 20*b* is also adjacent second hot layer 40*b*. Second cold layer 20*b* is separated from second hot layer by parting sheet 43*d*. Each of parting sheets (43*b*, 43*c*, and 43*d*) are configured to enable heat transfer between their contiguous and adjacent layers. Parting sheet 43*a* is adjacent to first cold layer 20*a* opposite of parting sheet 43*b*. Parting sheet 43*e* is adjacent to second hot layer 40*b* opposite of parting sheet 43*d*.

First cold inlet 22*a* and second cold inlet 22*b* of first cold layer 20*a* and second cold layer 20*b*, respectively, are on first side 12 and extend between third side 16 and fourth side 18 of core 11 of heat exchanger 10. First cold outlet 24*a* and second cold outlet 24*b* of first cold layer 20*a* and second cold layer 20*b*, respectively, are on second side 14 and extend between third side 16 and fourth side 18 of heat exchanger 10. First lower closure bar 26*a* and first upper closure bar 26*b* are on third side 16 and extend from first side 12 to second side 14. Second lower closure bar 28*a* and second upper closure bar 28*b* are opposite first lower closure bar 26*a* and first upper closure bar 26*b*, respectively, and are on fourth side 18 extending from first side 12 to second side 14. Plurality of first cold fins 30*a* and plurality of second cold fins 30*b* extend through first cold layer 20*a* and second cold layer 20*b*, respectively, between first end 12 and second end 14 and are spaced apart from each other between third side 16 and fourth side 18. First lower closure bar 26*a*, second lower closure bar 28*a*, plurality of first cold fins 30*a*, parting sheet 43*a*, and parting sheet 43*b* define first cold passages 32*a*. First upper closure bar 26*b*, second upper closure bar 28*b*, plurality of second cold fins 30*b*, parting sheet 43*c*, and parting sheet 43*d* define second cold passages 32*b*. First cold passages 32*a* and second cold passages 32*b* each extend between first side 12 and second side 14.

Third lower closure bar 48*a* and third upper closure bar 48*b* are on second side 14 and extend between third side 16 and fourth side 18. Third lower closure bar 48*a* is between parting sheet 43*b* and parting sheet 43*c*. Third upper closure bar 48*b* is between parting sheet 43*d* and parting sheet 43*e*. First closure tube 50*a* and second closure tube 50*b* are on first side 12, opposite of third lower closure bar 48*a* and third upper closure bar 48*b*, respectively, and extend between first side 12 and second side 14. First closure tube 50*a* is between parting sheet 43*b* and parting sheet 43*c*. First closure tube 50*a* functions as a closure bar for first hot layer 40*a*. Second closure tube 50*b* is between parting sheet 43*d* and parting sheet 43*e*. Second closure tube 50*b* functions as a closure bar for second hot layer 40*b*. Plurality of first hot fins 45*a* and plurality of second hot fins 45*b* are spaced between third lower closure bar 48*a* and third upper closure bar 48*b* and first closure tube 50*a* and second closure tube 50*b*, respectively, and extends between third side 16 and fourth side 18. Third lower closure bar 48*a*, first closure tube 50*a*, plurality of first hot fins 45*a*, parting sheet 43*b*, and parting sheet 43*c* define first hot passages 46*a* in first hot layer 40*a*. Third upper closure bar 48*b*, second closure tube 50*b*, plurality of second hot fins 45*b*, parting sheet 43*d*, and parting sheet 43*e* define second hot passages 46*b* in second hot layer 40*b*. In the example shown in FIG. 1, first hot passages 46*a* and second hot passages 46*b* are configured to direct hot airflow from third side 16 to fourth side 18. In another example, first hot passages 46*a* and second hot passages 46*b* can be configured to direct hot airflow from fourth side 18 to third side 16. All of core 11 of heat exchanger 10 is made from material(s) with high thermal conductivity to encourage heat transfer between cold layers (20*a* and 20*b*) and hot layers (40*a* and 40*b*).

As shown in FIG. 1, first hot layer 40*a* can be stacked between first cold layer 20*a* and second cold layer 20*b*, and second cold layer 20*b* can be stacked between first hot layer 40*a* and second hot layer 40*b*. In the example of FIG. 1, first closure tube 50*a* and second closure tube 50*b* are configured to prevent ice accretion on first cold inlet 22*a* and second cold inlet 22*b* of first cold layer 20*a* and second cold layer 20*b*, respectively. In another example, the number of cold layers and the number of hot layers can be modified to adjust the heat transfer capabilities of heat exchanger 10.

Core 11 of heat exchanger 10 is manufactured by stacking parting sheet 43*a*, first cold layer 20*a*, parting sheet 43*b*, first hot layer 40*a*, parting sheet 43*c*, second cold layer 20*b*, parting sheet 43*d*, second hot layer 40*b*, and parting sheet 43*e*, then brazing the layers together in a furnace. First cold layer 20*a* is made by placing first lower closure bar 26*a* on third side 16 and second lower closure bar 28*a* on fourth side 18. Then, the plurality of first cold fins 30*a* are spaced apart from each other between first lower closure bar 26*a* and second lower closure bar 28*a* and extending between first side 12 and second side 14. Parting sheet 43*b* is then placed on top of first lower closure bar 26*a* and second lower closure bar 28*a* to complete first cold layer 20*a*. Next, first hot layer 40*a* is made by placing third lower closure bar 48*a* on top of parting sheet 43*b* on second side 14 and extending between third side 16 and fourth side 18. Then, first closure tube 50*a* is placed on top of parting sheet 43*b* opposite of third lower closure bar 48*a* on first side 12 extending between third side 16 and fourth side 18. Plurality of first hot fins 45*a* are then placed on top of parting sheet 43*b*, spaced from one another between third lower closure bar 48*a* and first closure tube 50*a* and extending between third side 16 and fourth side 18. Parting sheet 43*c* is then placed atop third closure lower bar 48*a*, first closure tube 50*a*, and the plurality of first hot fins 45*a* to complete first hot layer 40*a*. Second cold layer 20*b* is made by placing first upper closure bar 26*b* on third side 16 and second upper closure bar 28*b* on fourth side 18. Then, the plurality of second cold fins 30*b* are spaced apart from each other between first upper closure bar 26*b* and second upper closure bar 28*b* and extending between first side 12 and second side 14. Parting sheet 43*d* is then placed on top of first upper closure bar 26*b* and second upper closure bar 28*b* to complete second cold layer 20*b*. Next, second hot layer 40*b* is made by placing third upper closure bar 48*b* on top of parting sheet 43*d* on second side 14 and extending between third side 16 and fourth side 18. Then, second closure tube 50*b* is placed on top of parting sheet 43*d* opposite of third upper closure bar 48*b* on first side 12 extending between third side 16 and fourth side 18. The plurality of second hot fins 45*b* are then placed on top of parting sheet 43*d*, spaced from one another between third upper closure bar 48*b* and second closure tube 50*b* and extending between third side 16 and fourth side 18. Parting sheet 43*e* is then placed atop third lower closure bar 48*a*, first closure tube 50*a*, and the plurality of first hot fins 45*a* to complete first hot layer 40*a*. Core 11 is then loaded into a furnace with braze foil inserted into each of the joints of core 11 to braze core 11 into one unitary, monolithic component.

First heating fluid passage 56*a* and second heating fluid passage 56*b* are contained within first closure tube 50*a* and second closure tube 50*b*, respectively, and extend between third side 16 and fourth side 18. In the example shown in FIG. 1, first closure tube 50*a* and second closure tube 50*b* are rectangular tubes. In another example, first closure tube 50*a* and second closure tube 50*b* can be cylindrical tubes, triangular tubes, or any other shape that fits between parting sheets (43*b*, 43*c*, 43*d*, and 43*e*) and accommodates first heating fluid passage 56*a* and second heating fluid passage 56*b*. First heating fluid passage 56*a* and second heating fluid passage 56*b* will be discussed in greater detail below with reference to FIGS. 2 and 3.

Figure 2:
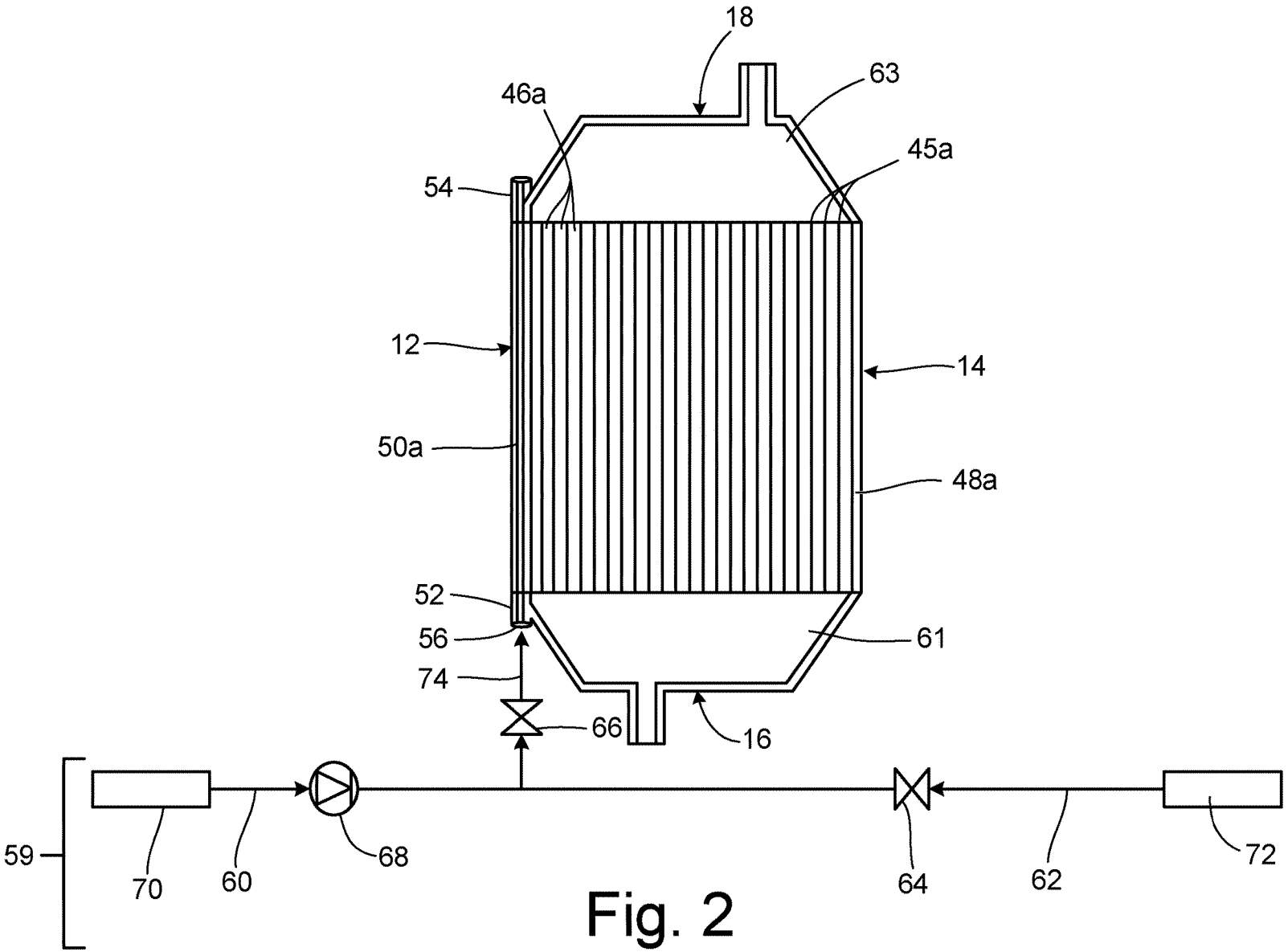
FIG. 2 is a schematic diagram of one example of a hot layer of the heat exchanger.

FIG. 2 is a schematic diagram of first hot layer 40*a* in core 11 of heat exchanger 10. Although the following discussion relates to first hot layer 40*a*, it is to be understood that the following disclosure equally applies to second hot layer 40*b*. Heat exchanger 10 also includes tube inlet manifold 52, tube outlet manifold 54, heating fluid system 59, inlet manifold 61, and outlet manifold 63. Heating fluid system 59 includes first fluid supply line 60, second fluid supply line 62, temperature control valve 64, flow control valve 66, check valve 68, first fluid source 70, second fluid source 72, and regulated heating fluid line 74.

Tube inlet manifold 52 is connected to first closure tube 50*a* on third side 16. Tube outlet manifold 54 is connected to first closure tube 50*a* on fourth side 18. First heating fluid passage 56*a* fluidically connects tube inlet manifold 52 and tube outlet manifold 54. Tube inlet manifold 52 is configured to direct a heating fluid from regulated heating fluid line 74 into first heating fluid passage 56*a*. Tube outlet manifold 54 receives the heating fluid after the heating fluid traverses first heating fluid passage 56*a*. First heating fluid passage 56*a* is configured to contain and transport the heating fluid, which flows from inlet manifold 52 to outlet manifold 54 and transfers heat through first closure tube 50*a* to first cold inlet 22*a* and second cold inlet 22*b* of first cold layer 20*a* and second cold layer 20*b*, respectively. The preceding discussion regarding first closure tube 50*a* is to be understood as equally applying to second closure tube 50*b*.

Inlet manifold 61 of first hot layer 40*a* is on third side 16 and extends between first side 12 and second side 14. Inlet manifold 61 is configured to receive the hot fluid via an inlet of inlet manifold 61 (not shown) and direct the hot fluid into first hot passages 46*a*. Outlet manifold 63 is on fourth side 18, opposite of inlet manifold 61, and extends between first side 12 and second side 14. Outlet manifold 63 is fluidically connected to inlet manifold 61 via first hot passages 46*a* of first hot layer 40*a*. Outlet manifold 63 receives the hot fluid after the hot fluid traverses first hot passages 46*a* and directs the hot fluid to an outlet (not shown) on outlet manifold 63. The preceding discussion regarding first hot layer 40*a* and first hot passages 46*a* is to be understood as equally applying to second hot layer 40*b* and second hot passages 46*b*.

First closure tube 50*a*, tube inlet manifold 52, tube outlet manifold 54, first fluid supply line 60, second fluid supply line 62, temperature control valve 64, flow control valve 66, check valve 68, first fluid source 70, second fluid source 72, and regulated heating fluid line 74 are all fluidically connected. Likewise, second closure tube 50*b*, tube inlet manifold 52, tube outlet manifold 54, first fluid supply line 60, second fluid supply line 62, temperature control valve 64, flow control valve 66, check valve 68, first fluid source 70, second fluid source 72, and regulated heating fluid line 74 are all fluidically connected. First fluid supply line 60 and second fluid supply line 62 carry fluids of different temperatures from first fluid source 70 and second fluid source 72 respectively. For instance, in one example first fluid source 70 could be a hot fluid source, e.g., from a hot side of a turbine or any other hot components of an engine, and second fluid source 72 could be a cold fluid source, e.g., from a cold side of a ram air heat exchanger or any other cold components of the engine. In another example, first fluid source 70 could contain a cold fluid, e.g., from a cold side of a ram air heat exchanger or any other cold components of the engine, and second fluid source 72 could contain a hot fluid, e.g., from a hot side of a turbine or any other hot components of an engine.

Temperature control valve 64 controls the quantity of fluid from first fluid supply line 60 and second fluid supply line 62 to control the temperature of the heating fluid (not shown) that flows through first closure tube 50*a* and second closure tube 50*b*. After temperature control valve 64 determines the temperature of the heating fluid (not shown), flow control valve 66 determines the rate at which the heating fluid flows into regulated heating fluid line 74 and ultimately through first closure tube 50*a* and second closure tube 50*b*. Temperature control valve 64 works in concert with flow control valve 66 to determine the melting capacity of the heating fluid (not shown) as it flows through first closure tube 50*a* and second closure tube 50*b*. Check valve 68 prevents the heating fluid from flowing back into first fluid source 70, thereby preventing contamination of the system.

In operation a first fluid (not shown) flows through first fluid supply line 60 and a second fluid (not shown) flows through second fluid supply line 62. Temperature control valve 64 determines the quantity of each the first fluid and the second fluid to control the heating fluid temperature. The fluid flows through flow control valve 66, which determines the quantity of the heating fluid that flows through first closure tube 50*a* and second closure tube 50*b*. From flow control valve 66, the fluid flows through tube inlet manifold 52, first closure tube 50*a* and second closure tube 50*b*, and out tube outlet manifold 54. While the heating fluid flows through first closure tube 50*a* and second closure tube 50*b*, the heating fluid's heat is transferred through first closure tube 50*a* and second closure tube 50*b*, thereby preventing or melting ice accretion on the above or below first inlet 22*a* and second inlet 22*b* of first cold layer 20*a* and second cold layer 20*b*, respectively.

FIG. 2 shows an alternative design where inlet manifold 61 and tube inlet manifold 52 are one unitary, monolithic component and where outlet manifold 63 and tube outlet manifold 54 are one unitary, monolithic component. In each of the above examples, inlet manifold 61 and tube inlet manifold 52 are fluidically isolated from one another and outlet manifold 63 and tube outlet manifold 54 are fluidically isolated from one another. When inlet manifold 61 and tube inlet manifold 52 are one unitary, monolithic component they can be additively manufactured. Likewise, when outlet manifold 63 and tube outlet manifold 54 are one unitary, monolithic component they can be additively manufactured. Core 11 is manufactured, as described above with FIG. 1. Then, the additively manufactured unitary, monolithic component including inlet manifold 61 and tube inlet manifold 52 can be attached to core 11 of heat exchanger 10 by welding, brazing, or any other method of mechanically coupling two metals. Similarly, the additively manufactured unitary, monolithic component including outlet manifold 63 and tube outlet manifold 54 can be attached to core 11 of heat exchanger 10 by welding, brazing, or any other method of mechanically coupling two metals.

Figure 3:
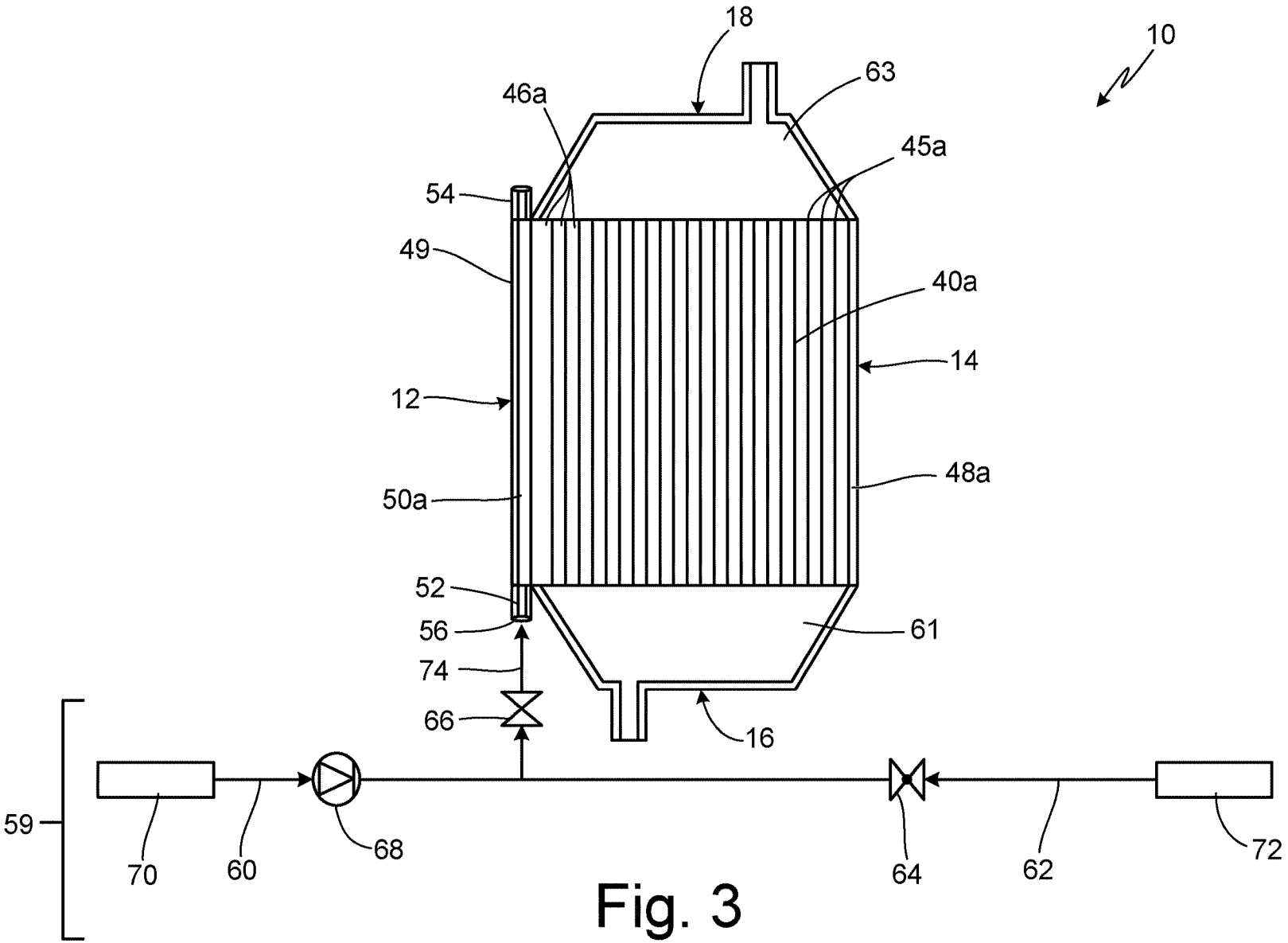
FIG. 3 is a schematic diagram showing another example of the hot layer of the heat exchanger.

FIG. 3 is schematic view of another example of first hot layer 40*a* of heat exchanger 10. First hot layer 40*a* includes fourth closure bar 49. In the example shown in FIG. 3, fourth closure bar 49 is on first side 12 of heat exchanger 10 extending between third side 16 and fourth side 18. First closure tube 50*a* is attached to fourth closure bar 49. First closure tube 50*a* can be attached to fourth closure bar by welding, brazing, or any other way of mechanically coupling two metals. The preceding discussion regarding first closure tube 50*a* is to be understood as equally applying to second closure tube 50*b*.

The example shown in FIG. 3 shows an alternative design where inlet manifold 61 and tube inlet manifold 52 are each solitary components and where outlet manifold 63 and tube outlet manifold 54 are each solitary components. In the above examples, inlet manifold 61 and tube inlet manifold 52 are fluidically isolated from one another and outlet manifold 63 and tube outlet manifold 54 are fluidically isolated from one another.

After core 11 is manufactured, as described above with FIG. 1, inlet manifold 61 and outlet manifold 63 are attached to core 11 and first cold layer 20*a* and second cold layer 20*b* will likewise have an inlet manifold (not shown) and an outlet manifold (not shown) attached thereto. Tube inlet manifold 52 and tube outlet manifold 54 are attached to first closure tube 50*a* and second closure tube 50*b*. Then, tube inlet manifold 52 is attached to heating fluid system 59 via regulated heating fluid line 74.

Discussion of Possible Embodiments

The following are non-exclusive descriptions of possible embodiments of the present invention.

A heat exchanger includes a first side opposite a second side and a third side opposite a fourth side. The third side and the fourth side extend from the first side to the second side. The heat exchanger also includes a cold layer with an inlet at the first side of the heat exchanger and an outlet at the second side of the heat exchanger. The cold layer also includes a cold passage extending from the inlet to the outlet. The heat exchanger also includes a hot layer with an inlet manifold at the third side of the heat exchanger extending between the first side and the second side and an outlet manifold at the fourth side of the heat exchanger opposite the inlet manifold and extending between the first side and the second side. The hot layer also includes a hot passage extending from the inlet manifold to the outlet manifold and a tube on the first side of the heat exchanger extending from the third side to the fourth side.

The heat exchanger of the preceding paragraph can optionally include, additionally and/or alternatively, any one or more of the following features, configurations and/or additional components:

wherein the cold layer further comprises: a first closure bar on the third side extending from the first side to the second side; a second closure bar on the fourth side extending from the first side to the second side; a plurality of fins between the first closure bar and the second closure bar extending from the first side to the second side; and a plurality of cold passages defined by the first closure bar, the second closure bar, and the plurality of fins of the cold layer;

wherein the hot layer further comprises: a third closure bar on the second side of the heat exchanger extending from the third side to the fourth side; a plurality of fins between the tube and the third closure bar extending from the third side to the fourth side; a plurality of passages defined by the tube, the third closure bar, and the plurality of fins of the hot layer;

further comprising: a second cold layer; and a second hot layer, wherein: the second cold layer is stacked between the hot layer and the second hot layer; the second hot layer is stacked between the cold layer and the second cold layer; and the second hot layer comprises a second tube on the first side of the heat exchanger and extending from the third side to the fourth side;

further comprising: a first fluid supply line configured to contain a first fluid; a second fluid supply line configured to contain a second fluid; and a control valve, wherein the control valve is fluidically connected to the first fluid supply line and the second fluid supply line, and wherein the control valve determines a quantity of the first fluid and quantity of the second fluid that flows into the tube of the hot layer and the tube of the second hot layer;

wherein the tube of the hot layer comprises: a tube inlet manifold on the third side of the heat exchanger; and a tube outlet manifold on the fourth side of the heat exchanger, wherein the tube of the hot layer fluidically connects the tube inlet manifold and the tube outlet manifold;

wherein the tube inlet manifold and the inlet manifold of the hot layer are a unitary, monolithic component, and wherein the tube inlet manifold and the inlet manifold of the hot layer are additively manufactured;

wherein the tube outlet manifold and the outlet manifold of the hot layer are one unitary, monolithic component, and wherein the tube outlet manifold and the outlet manifold of the hot layer are additively manufactured;

wherein the hot layer further comprises: a third closure bar on the second side of the heat exchanger extending from the third side to the fourth side; a fourth closure bar on the first side of the heat exchanger extending from the third side to the fourth side, wherein the tube is attached to the fourth closure bar; a plurality of fins between the third closure bar and the fourth closure bar extending from the third side to the fourth side; and a plurality of passages defined by the third closure bar, the fourth closure bar, and the plurality of fins of the hot layer extending from the third side to the fourth side;

further comprising: a first fluid supply line configured to contain a first fluid; a second fluid supply line configured to contain a second fluid; and a control valve, wherein the control valve is fluidically connected to the first fluid supply line and the second fluid supply line, and wherein the control valve determines a quantity of the first fluid and a quantity of the second fluid that flows into he tube of the hot layer;

wherein the tube of the hot layer comprises: a tube inlet manifold on the third side of the heat exchanger; and a tube outlet manifold on the fourth side of the heat exchanger, wherein the tube of the hot layer fluidically connects the tube inlet manifold and the tube outlet manifold;

wherein the tube inlet manifold and the inlet manifold of the hot layer are a unitary, monolithic component, and wherein the tube inlet manifold and the inlet manifold of the hot layer are additively manufactured; and wherein the tube outlet manifold and the outlet manifold of the hot layer are one unitary, monolithic component, and wherein the tube outlet manifold and the outlet manifold of the hot layer are additively manufactured.

In another example, a heat exchanger includes a first side opposite a second side and a third side opposite a fourth side, wherein the third side and the fourth side extend from the first side to the second side. The heat exchanger also includes a cold layer with a first closure bar on the third side extending from the first side to the second side, a second closure bar on the fourth side extending from the first side to the second side, and a cold passage between the first closure bar and the second closure bar, wherein the cold passage includes an inlet on the first side. The heat exchanger also includes a hot layer adjacent the cold layer. The hot layer includes a third closure bar on the second side extending from the third side to the fourth side, a closure tube on the first side extending from the third side to the fourth side. The closure tube includes a heating fluid passage extending from the third side to the fourth side. The hot layer also includes a hot passage between the third closure bar and the closure tube. The hot passage includes an inlet on the third side and an outlet on the fourth side.

The heat exchanger of the preceding paragraph can optionally include, additionally and/or alternatively, any one or more of the following features, configurations and/or additional components:

wherein the heat exchanger further comprises: an inlet manifold on the third side of the heat exchanger; and an outlet manifold on the fourth side of the heat exchanger, wherein the closure tube fluidically connects the inlet manifold and the outlet manifold;

wherein the hot layer further comprises: an inlet manifold on the third side; and an outlet manifold on the fourth side, wherein the inlet manifold and the outlet manifold extend between the first side and the second side;

wherein the inlet manifold of the hot layer and the inlet manifold of the closure tube are one unitary, monolithic component, and wherein the inlet manifold of the hot layer and the inlet manifold of the closure tube are additively manufactured; and wherein the outlet manifold of the hot layer and the outlet manifold of the closure tube are one unitary, monolithic component, and wherein the outlet manifold of the hot layer and the outlet manifold of the closure tube are additively manufactured.

In another example, a method of preventing ice accretion on a cold inlet of a cold layer of a heat exchanger includes directing a cold flow through the cold inlet of the cold layer at a first side of the heat exchanger and out a cold outlet of the cold layer at a second side of the heat exchanger. The method also includes directing a hot flow through a hot inlet header of a hot layer at a third side of the heat exchanger and out the hot outlet header of the hot layer at the fourth side of the heat exchanger. The method also includes directing a heating fluid through a tube located on the first side of the heat exchanger. The heating fluid heats the cold inlet of the cold layer of the heat exchanger.

The method of the preceding paragraph can optionally include, additionally and/or alternatively, any one or more of the following features, configurations and/or additional components:

further comprising: controlling a temperature of the heating fluid via a temperature control valve, wherein the temperature control valve determines a quantity of a first fluid and a quantity of a second fluid that are mixed to form the heating fluid; and controlling heat transfer in the first side of the heat exchanger by controlling a flow of the heating fluid via a flow control valve between the tube and the temperature control valve.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A heat exchanger comprising:

a first side opposite a second side;

a third side opposite a fourth side, wherein the third side and the fourth side extend from the first side to the second side;

a cold layer comprising:

an inlet at the first side of the heat exchanger;

an outlet at the second side of the heat exchanger; and a cold passage extending from the inlet to the outlet;

a hot layer comprising:

a hot layer inlet manifold at the third side of the heat exchanger extending between the first side and the second side;

a hot layer outlet manifold at the fourth side of the heat exchanger opposite the inlet manifold and extending between the first side and the second side;

a hot passage extending from the inlet manifold to the outlet manifold; and a tube on the first side of the heat exchanger extending from the third side to the fourth side, wherein the tube extends fully parallel with the hot passage extending from the inlet manifold to the outlet manifold;

a tube inlet manifold on the third side of the heat exchanger, wherein the tube inlet manifold is fluidically connected to the tube, the tube inlet manifold and the hot layer inlet manifold are a unitary, monolithic component, and the tube inlet manifold and the hot layer inlet manifold are additively manufactured; and a tube outlet manifold on the fourth side of the heat exchanger, wherein the tube outlet manifold is fluidically connected to the tube, the tube outlet manifold and the hot layer outlet manifold are one unitary, monolithic component, and the tube outlet manifold and the hot layer outlet manifold are additively manufactured;

wherein the tube fluidic ally connects the tube inlet manifold to the tube outlet manifold, the tube inlet manifold is fluidically isolated from the hot layer inlet manifold, and the tube outlet manifold is fluidically isolated from the hot layer outlet manifold;

a second hot layer comprising a second tube on the first side of the heat exchanger and extending from the third side to the fourth side; and a second cold layer, the second cold layer stacked between the hot layer and the second hot layer.

2. The heat exchanger of claim 1, wherein the cold layer further comprises:

a first closure bar on the third side extending from the first side to the second side;

a second closure bar on the fourth side extending from the first side to the second side;

a plurality of fins between the first closure bar and the second closure bar extending from the first side to the second side; and a plurality of cold passages defined by the first closure bar, the second closure bar, and the plurality of fins of the cold layer.

3. The heat exchanger of claim 2, wherein the hot layer further comprises:

a third closure bar on the second side of the heat exchanger extending from the third side to the fourth side;

a plurality of fins positioned between the tube and the third closure bar extending from the third side to the fourth side; and a plurality of hot passages defined by the tube, the third closure bar, and the plurality of fins of the hot layer.

4. The heat exchanger of claim 1, further comprising: a first fluid supply line configured to contain a first fluid; a second fluid supply line configured to contain a second fluid; and a control valve, wherein the control valve is fluidically connected to the first fluid supply line and the second fluid supply line, and wherein the control valve determines a quantity of the first fluid and a quantity of the second fluid that flows into the tube of the hot layer and the second tube of the second hot layer.

5. The heat exchanger of claim 2, wherein the hot layer further comprises:

a third closure bar on the second side of the heat exchanger extending from the third side to the fourth side;

a fourth closure bar on the first side of the heat exchanger extending from the third side to the fourth side, wherein the tube is attached to the fourth closure bar;

a plurality of fins between the third closure bar and the fourth closure bar extending from the third side to the fourth side; and a plurality of passages defined by the third closure bar, the fourth closure bar, and the plurality of fins of the hot layer extending from the third side to the fourth side.

6. The heat exchanger of claim 5, further comprising:

a first fluid supply line configured to contain a first fluid;

a second fluid supply line configured to contain a second fluid; and a control valve, wherein the control valve is fluidically connected to the first fluid supply line and the second fluid supply line, and wherein the control valve determines a quantity of the first fluid and a quantity of the second fluid that flows into the tube of the hot layer.

7. A heat exchanger comprising:

a first side opposite a second side;

a third side opposite a fourth side, wherein the third side and the fourth side extend from the first side to the second side;

a cold layer comprising:

a first closure bar on the third side extending from the first side to the second side;

a second closure bar on the fourth side extending from the first side to the second side; and a cold passage between the first closure bar and the second closure bar, wherein the cold passage comprises an inlet on the first side;

a hot layer adjacent the cold layer, the hot layer comprising:

a third closure bar on the second side extending from the third side to the fourth side;

a closure tube on the first side extending from the third side to the fourth side, wherein the closure tube comprises a heating fluid passage extending from the third side to the fourth side, such that the heating fluid passage is parallel with the third closure bar from the third side to the fourth side; and a hot passage between the third closure bar and the closure tube, wherein the hot passage comprises an inlet on the third side and an outlet on the fourth side;

a control valve fluidly coupled to the closure tube of the hot layer, wherein a first fluid supply line is configured to transfer a first fluid to the control valve and a second fluid supply line is configured to transfer a second fluid to the control valve, and wherein the first fluid and the second fluid flow through the control valve before flowing into the closure tube;

a second hot layer comprising a second closure tube on the first side of the heat exchanger and extending from the third side to the fourth side; and a second cold layer, the second cold layer stacked between the hot layer and the second hot layer.

8. The heat exchanger of claim 7, wherein the heat exchanger further comprises:

an inlet manifold on the third side of the heat exchanger; and an outlet manifold on the fourth side of the heat exchanger, wherein the hot passage fluidically connects the inlet manifold and the outlet manifold, and wherein the inlet manifold and the outlet manifold extend between the first side and the second side.

9. The heat exchanger of claim 8, wherein the hot layer further comprises:

a tube inlet manifold on the third side; and a tube outlet manifold on the fourth side, wherein the closure tube of the hot layer fluidically connects the tube inlet manifold and the tube outlet manifold.

10. The heat exchanger of claim 9, wherein the tube inlet manifold and the inlet manifold of the hot layer are one unitary, monolithic component, and wherein the tube inlet manifold and the inlet manifold are additively manufactured.

11. The heat exchanger of claim 9, wherein the tube outlet manifold and the outlet manifold of the hot layer are one unitary, monolithic component, and wherein the tube outlet manifold and the outlet manifold of the hot layer are additively manufactured.

12. A method of preventing ice accretion on an inlet of one or more cold layers of a heat exchanger comprising:

directing a cold flow through an inlet of a first cold layer and through an inlet of a second cold layer at a first side of the heat exchanger and out an outlet of the first cold layer and out an outlet of the second cold layer at a second side of the heat exchanger;

directing a hot flow through an inlet manifold and into a first hot layer and a second hot layer at a third side of the heat exchanger and out an outlet manifold of the first hot layer and the second hot layer at a fourth side of the heat exchanger;

directing a heating fluid through a first tube located on the first side of the heat exchanger, wherein the heating fluid heats the inlet of the first cold layer of the heat exchanger, and wherein the first tube is positioned perpendicular to the cold flow flowing through the inlet of the first cold layer from the third side of the heat exchanger to the fourth side of the heat exchanger; and directing the heating fluid through a second tube of the second hot layer, the second tube located on the first side of the heat exchanger, wherein the second tube is positioned perpendicular to the cold flow flowing through the inlet of the second cold layer from the third side of the heat exchanger to the fourth side of the heat exchanger;

wherein a temperature control valve is fluidly coupled to the first tube;

wherein a first fluid supply line is configured to transfer a first fluid to the temperature control valve and a second fluid supply line is configured to transfer a second fluid to the temperature control valve to control a temperature of the heating fluid flowing through the first tube;

wherein the first fluid and the second fluid flow through the control valve before flowing into the first tube; and wherein the second cold layer is stacked between the first hot layer and the second hot layer.

13. The method of claim 12, wherein the temperature control valve determines a quantity of the first fluid and a quantity of the second fluid that are mixed to form the heating fluid.

* * * * *